US005966764A

United States Patent [19]

Vodicka

[11] Patent Number: 5,966,764

[45] Date of Patent: Oct. 19, 1999

[54] ROLL BEAM GIRDER SYSTEM FOR BRIDGES

[76] Inventor: Dennis A. Vodicka, 206 8th Corso, Nebraska City, Nebr. 68410

[21] Appl. No.: 09/109,087

[22] Filed: Jul. 2, 1998

[51] Int. Cl.[6] ..... E01D 2/00; E01D 21/00

[52] U.S. Cl. ..... 14/74.5; 14/77.1

[58] Field of Search ..... 14/74.5, 75, 76, 14/77.1, 78, 13

[56] References Cited

U.S. PATENT DOCUMENTS

| | | | |
|---|---|---|---|
| 349,345 | 9/1886 | Godman | 14/74.5 |
| 811,257 | 1/1906 | Strauss . | |
| 1,688,128 | 10/1928 | Moccetti . | |
| 2,336,622 | 12/1943 | LeTourneau . | |
| 3,365,852 | 1/1968 | Pitillo . | |
| 3,425,076 | 2/1969 | Finsterwalder . | |
| 4,042,991 | 8/1977 | Macy et al. . | |
| 5,526,544 | 6/1996 | Wiedeck et al. . | |

FOREIGN PATENT DOCUMENTS

| | | |
|---|---|---|
| 1939737 | 2/1971 | Germany . |
| 1474201 | 4/1989 | U.S.S.R. . |

*Primary Examiner*—Thomas B. Will
*Assistant Examiner*—Raymond W Addie
*Attorney, Agent, or Firm*—Richard C. Litman

[57] ABSTRACT

The roll beam girder system for bridges has beams constructed from two end sections and a keystone center section. The two end sections have a top rolled steel beam welded to a bottom rolled steel beam, the top beam comprising about two-thirds of the total height of the section, the top beam being shorter than the bottom beam at the end joining the keystone section, the projecting end of the bottom beam having a slight camber. The keystone section has a top girder and triangular bottom key sections. The end sections and the keystone section have mating 45° ends, with the ends of the top beam of the keystone section resting on the top of the projecting end of the bottom beam of the end section, a compression splice being formed by a row of nine bolts through the flanges on either side of the web of the mating end section and keystone section beams. Because of the slight camber of the projecting end of the end section and the nature of the compression splice, the bending moments are fixed, there is a slight curvature at the keystone section, and the load is borne by the end supports. Precast reinforced concrete planks may be welded transversely between the beams to form the floor of the bridge, which may optionally be smoothed with a two inch layer of concrete to form the roadway. The beams are supported by end supports. In this manner a roll beam bridge having a single span from 60 feet to 150 feet may be constructed.

9 Claims, 8 Drawing Sheets

ROLL BEAM GIRDER SYSTEM FOR BRIDGES

BACKGROUND OF THE INVENTION

1. Field of the Invention

The present invention relates to girder systems for bridges, and particularly to a roll beam bridge. It includes a method of forming compression splices for steel beams, a system of girders for the frame of the bridge using rolled beams, and a bed of reinforced concrete planks.

2. Description of the Related Art

Bridges may be broadly classified as fixed or moveable. Fixed bridges may be further classified as beam, arch and suspension. While all bridges must carry the full weight of the bridge and the traffic on their foundation, it is significant to note that arch bridges are in compression and thrust outward on their end supports or bearings, while suspension bridges are in tension and apply a continual pull on their end supports.

While there are several types of fixed, beam bridges, for purposes of understanding the present invention in terms of the related art, it is useful to note that beam bridges include types known as rolled beam, plate girder, box girder and continuous. Rolled beam bridges use steel girders rolled as a single, integral unit at the mill in various shapes, such as I-beam, H-beam, T-beam, etc. Roll beam bridges generally are useful for short spans of 50 to 150 feet. Plate girder bridges employ steel girders joined to make different shapes by welding or by bolts or rivets. An I-beam, for example, may be constructed from three plates, a top flange, bottom flange, and web, often using angles to construct the girder. Plate girders generally are capable of having greater stiffness than rolled beams and permit longer spans. Box girders are constructed from four plates welded together into a box shape, and have been used for spans from 100 ft to 850 ft. Continuous bridges are supported at three or more points, and are capable of resisting bending moments and shear at all sections throughout their length.

An additional consideration includes the material used to construct the beams. Modern bridges are generally constructed from steel or concrete. Bridges made of reinforced concrete were either arch bridges, slab bridges of quite short span, generally consisting of a reinforced concrete slab extending from end support to end support, or deck girder bridges having a concrete slab integral with concrete girders. The development of prestressed concrete has led to increased use of concrete in bridge construction. Prestressing involves stretching the steel reinforcement bars or wires before or during casting of the concrete to increase the compressive strength of the concrete, saving about one-fourth the volume of concrete and about three-fourths the weight of reinforcing steel. Prestressed concrete can be used in spans up to 600 feet, and longer spans are possible with cable support.

The present invention relates to a single span rolled beam bridge of about 60 feet to 150 feet in length using steel girders of the rolled beam variety. Currently rolled beam girders are custom made, in lengths of 120 feet or more. Such construction methods require special permits for transportation of the beams to the bridge site. Once erected, contractors must lay out concrete forms between the beams, which requires that the workers be supported by cables, construction of sufficient foundations for safety equipment, and other safety measures which alone add about 90 days to construction time, as well as hazards to health and safety. The present invention allows prefabricated construction of the beams from roll beam girders in sections which may be transported to the job site without special permits, and flooring made from precast reinforce concrete planks. A novel method of making a compression splice between the steel girders permits such a construction technique. The construction of the sections and the splice permit the moments to be fixed and borne by the end supports. The prior art does not disclose a similar method of bridge or girder construction.

U.S. Pat. No. 811,257, issued Jan. 30, 1906 to Joseph B. Strauss, discloses a concrete or concrete and steel bridge having hollow concrete forms for beam girders and hollow concrete forms for transverse joists, connected by steel bars and loops, the hollow forms being erected to form a frame and filled with concrete to form a concrete bridge using prefabricated forms. U.S. Pat. No. 1,688,128, issued Oct. 16, 1928 to Ernest Moccetti, discloses reinforced concrete girders having webbed structures in which the concrete in not continuously reinforced, but has main tensile reinforcements in zones of the greatest tension and special tension reinforcements in the webs for lighter weight, greater internal strength and smaller bulk.

U.S. Pat. No. 2,336,622, issued Dec. 14, 1943 to Robert G. LeTourneau, teaches the use of trapezoidal box beam girders with joists extending into a supported by the beams, supporting a solid metal flooring. U.S. Pat. No. 3,365,852, issued Jan. 30, 1968 to Ronald J. Pitillo, shows structural framing units made by cutting a triangular piece from the web of an I-beam, cutting the I-beam longitudinally with cutting torches, and rejoining the beam in the shape of trusses, etc., using the triangle to support the joints. Pitillo shows the construction of specialty trusses and roof beams, but no method suitable to the construction of bridge beams, and particular not to end sections and keystone sections having multiple beams cut in specific ratios of web beam sizes and at specific angles and joined by bolts through the flanges to form a splice.

U.S. Pat. No. 3,425,076, issued Feb. 4, 1969 to Ulrich Finsterwalder, shows a method for joining the spans of a highway bridge between two cantilevered spans using resilient tensioning members rigidly connected to adjoining sections composed of tendons piercing concrete joists and covered by the road surface. U.S. Pat. No. 4,042,991, issued Aug. 23, 1977 to Macy, et al., describes a portable load carrying structure, particularly for use in the Arctic to span breaks in the ice, consisting of I-beams, preferably made of aluminum, hinged together in parallel so they fold for compact storage and transport.

U.S. Pat. No. 5,526,544, issued Jun. 18, 1996 to Wiedeck, et al., shows a bridge having a flat base body and at least one roadway surface pivotally connected to the base body where the roadway surface may be pivoted above the base body to form a bridge. German Patent No. 1,939,737, published Feb. 18, 1971, teaches a method of building a prestressed concrete bridge which uses an orthotropic concrete slab roadway.

Soviet Invention Certificate No. 1,474,201, published Apr. 23, 1989, describes a method of building a bridge with a "zero bending moment" using alternating sections composed of two parts, including two end span sections with beams having a reinforced concrete top and metal bottom, and a center section with a metal top and reinforced concrete bottom with an orthotropic roadway in which the metal parts of the beams are placed under tension by tension members at the end supports and the junctions of the end sections with the center section, and in which the concrete is in compression. The bride is a continuous bridge.

None of the above inventions and patents, taken either singularly or in combination, is seen to describe the instant invention as claimed. Thus a roll beam girder system for bridges solving the aforementioned problems is desired.

SUMMARY OF THE INVENTION

The roll beam girder system for bridges has beams constructed from two end sections and a keystone center section. The two end sections have a top roll beam welded to a bottom roll beam, the top beam comprising about two-thirds of the total height of this section, the top beam being shorter than the bottom beam at the end joining the keystone section, the projecting end of the bottom beam having a slight camber. The keystone section has a top girder and triangular bottom key sections. The end sections and the keystone section have mating 45° ends, with the ends of the top beam of the keystone section resting on the top of the projecting end of the bottom beam of the end section, a compression splice being formed by a row of nine bolts through the flanges on either side of the web of the mating end section and keystone section beams. Because of the slight camber of the projecting end of the end section and the nature of the compression splice, the bending moments are fixed, there is a slight curvature at the keystone section, and the load is borne by the end supports. Precast reinforced concrete planks may be welded transversely between the beams to form the floor of the bridge, which may optionally be smoothed with a two inch layer of concrete to form the roadway. The beams are supported by end supports. In this manner a roll beam bridge having a single span from 60 feet to 150 feet may be constructed.

The roll beam girder system for bridges has the advantage that the two end sections and the keystone sections may be preassembled in the shop and transported to the job site. Since no section is greater than about 60 feet in length, no special permits are required for transportation of the beam sections. The roll beam girders further permit the use of precast concrete planks, avoiding the safety hazards, costs, and time delays occasioned by the necessity of forming and setting concrete flooring on the bridge site.

The compression splice may be modified for use with a plate girder as a useful alternative to a traditional friction splice. This is accomplished by resting the projecting end of one plate girder on top of the projecting end of second plate girder, each of the projecting ends being one-half the height of each girder, their ends having mating 45° surfaces, the splice being secured by two rows of nine bolts each through the flanges of the overlapping projecting ends.

Accordingly, it is a principal object of the invention to provide a roll beam girder system for bridges which permits construction of a single span roll beam bridge in which the bending moments are fixed and the load is in compression on the end supports due to a slight curvature of the beams.

It is another object of the invention to reduce safety hazards, costs, and delays in the construction of beam bridges by providing a roll beam girder system in which precast reinforced concrete planks may be welded to the rolled steel beams.

It is a further object of the invention to reduce delays in construction due to the necessity of obtaining special transportation permits for oversized beams by providing a roll beam girder which is prefabricated in three sections, each of which may be transported separately to the bridge site without the necessity of special transportation permits, and assembled on site.

Still another object of the invention is to provide an improved compression splice as a method for joining steel beams to form beams for use in bridge construction.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
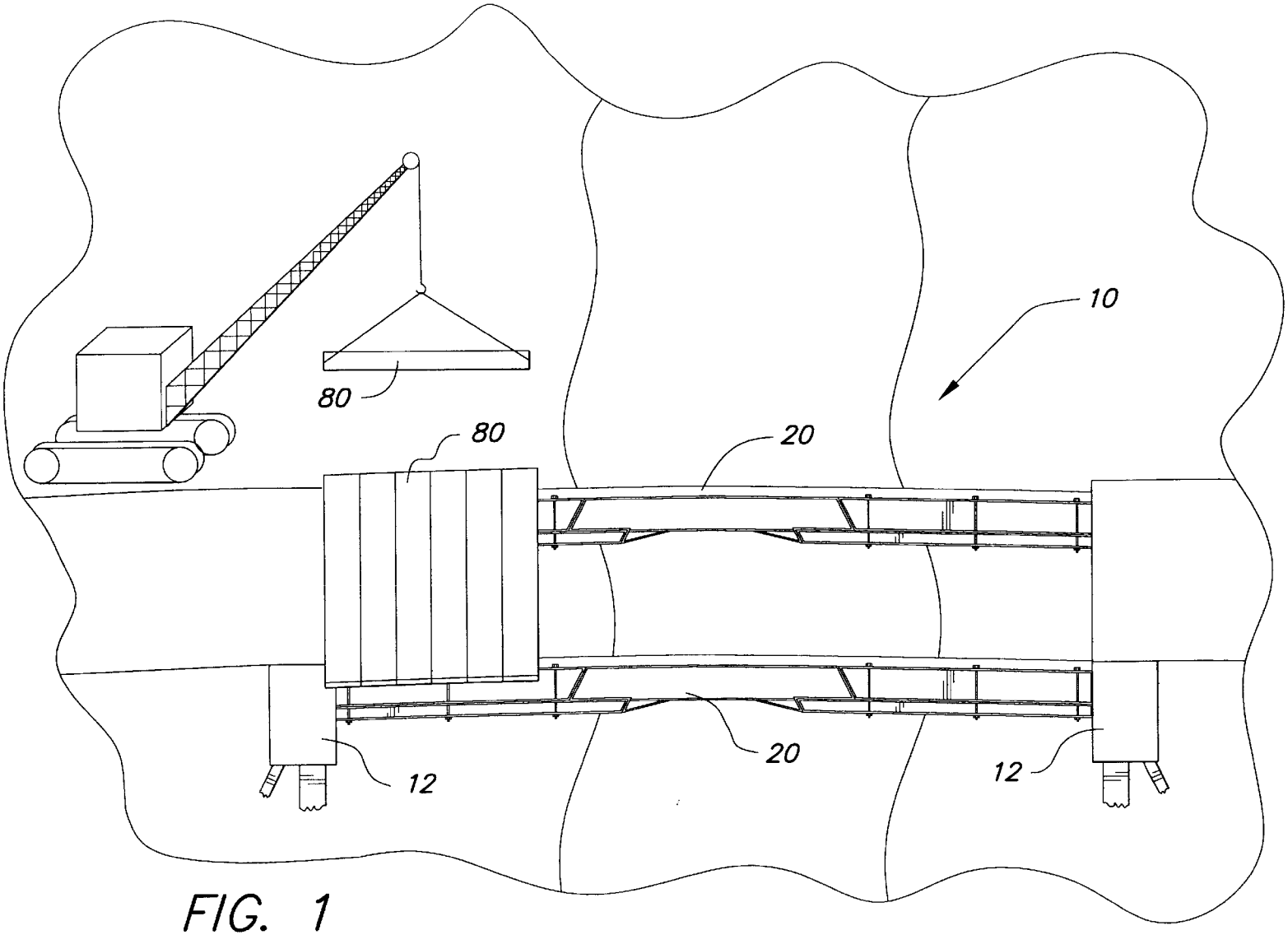
FIG. 1 is an largely diagrammatic perspective environmental view of a roll beam girder system for bridges according to the present invention showing a roll beam bridge under construction.

The present invention is a roll beam girder system for bridges which provides a novel frame for building a beam bridge using girders made from rolled steel beams. FIG. 1 shows an environmental perspective view of a roll beam bridge 10 using the roll beam girder system according to the present invention. The bridge 10 is a single span bridge supported by concrete and steel abutments serving as end supports 12 for the roll beam girder system. The figure shows concrete planks 80 being laid transversely across the flanges of the beams 20. As shown, the concrete planks 80 may be lifted by a crane for positioning on the beams 20.

Figure 2:
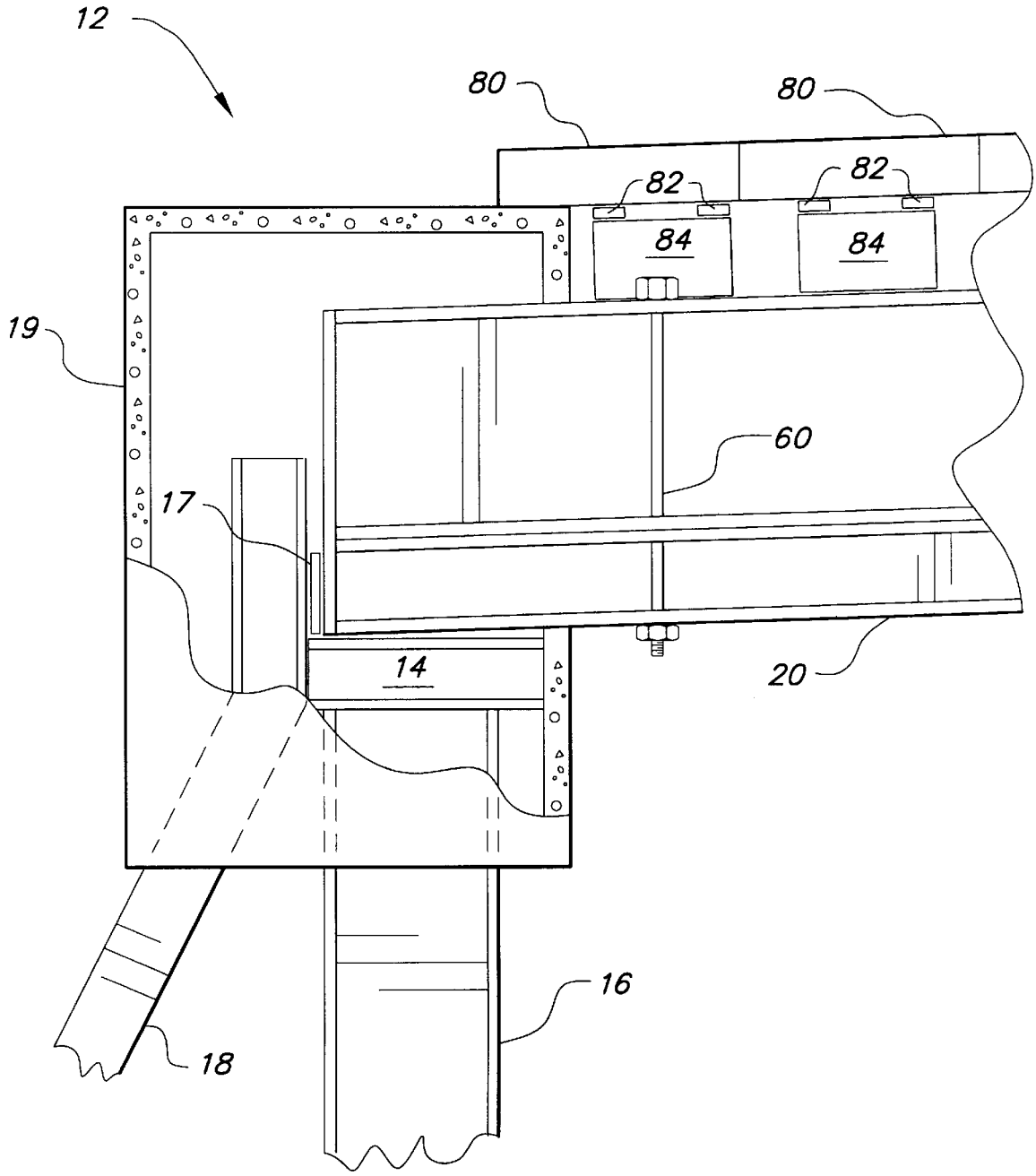
FIG. 2 is a partial sectional view of an end support for the roll beam girder system according to the present invention with the concrete abutment partially cut away.

The end supports 12 or abutments are shown more particularly in FIG. 2. Each support includes a girder saddle 14 having a side centered on and welded to a steel piling 16 supported vertically by the ground. The girder saddle 14 is essentially two short beam sections abutted at a 90° angle to form a butt joint and welded together to support an end of the beam 20. The saddle 14 supports the bottom of the beam 20 horizontally and an end of the beam 20 vertically. There may be one or more shims 17 disposed between the saddle 14 and the end of the beam 20. The saddle 14 is also supported by a steel batter piling 18 supported by the ground and mounted at an angle to oppose any forces driving against the support 12 laterally. The end support 12 is enclosed in a concrete housing 19.

Figure 3:
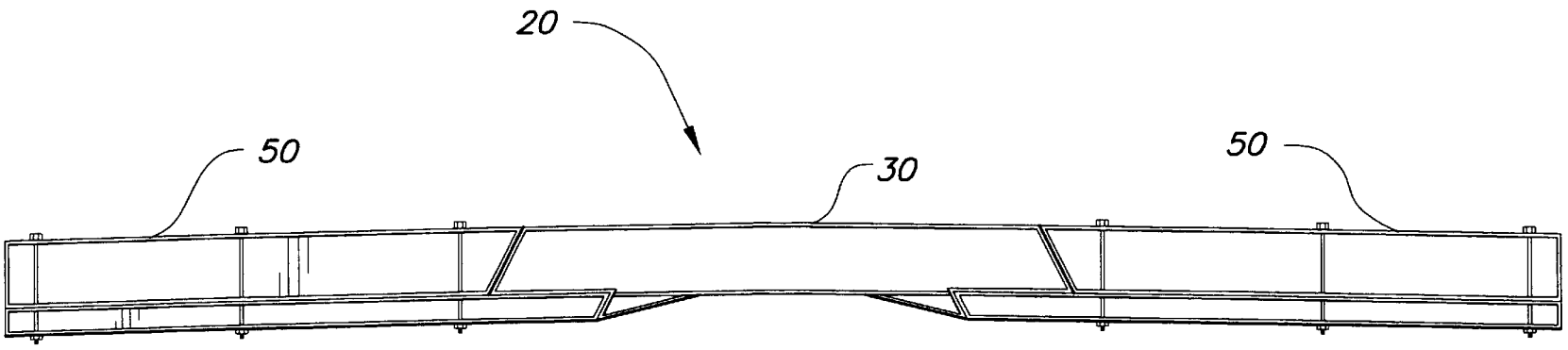
FIG. 3 is a lateral view of the roll beam girder system according to the present invention.
Figure 4:
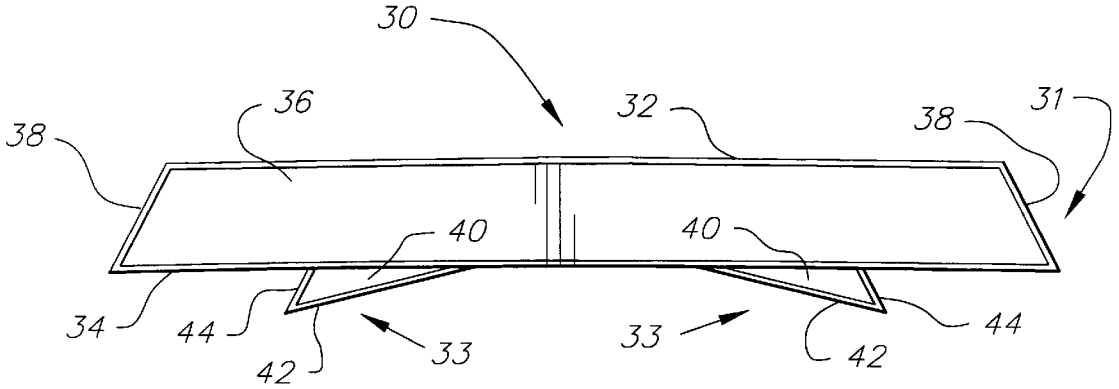
FIG. 4 is a lateral view showing the keystone section of the roll beam girder system according to the present invention.

The roll beam girder system is shown more particularly in FIGS. 3 through 8. As shown in FIG. 3, a beam 20 constructed according to the roll beam girder system of the present invention includes a keystone section 30 in the center and two end sections 50. The keystone section 30 is shown more particularly in FIG. 4, and comprises a top section 31 and a bottom section 33. The top section 31 is a rolled steel I-beam having a top flange 32 disposed horizontally, a bottom flange 34 disposed parallel to the top flange 32, and a web 36 disposed vertically between flanges 32 and 34. At either end of the keystone section 30, the beam is cut transversely to the longitudinal axis and at an angle and a flat cover plate or end plate 38 is welded to the end of the beam. The flat end plates 38, typically ¾" plate, and preferably form an angle of 45° with the bottom flange 34.

The bottom section 33 is composed of a pair of triangular key locks 40 fixedly attached to the bottom flange 34. Each of the key locks 40 has a bottom flange 42 and an end plate 44, typically ¾" plate. The end plates 44 preferably form an angle of 45° with the bottom flange 34 of the keystone 30 beam. The bottom flange 42 of the key lock 40 slopes from one end of its end plate 44 to the bottom flange 34 of the keystone section 30, terminating some distance short of the midpoint of the longitudinal axis of the keystone 30.

The length of the keystone section 30 is about one-third the length of the span of the bridge 10, the span being between about 60 feet and 150 feet. The key locks 40 are generally disposed so that the distance from the junction of the key lock end plate 44 with the bottom flange 34 of the keystone 30 to the nearest end of the bottom flange 34 is at a distance equal to the length the bottom flange 42 of the key lock 40 projects onto the bottom flange of the keystone 30. Typically this distance is about ten feet. The effect of this disposition is to leave a portion of the keystone beam 30 projecting beyond the key lock 40.

Figure 5:
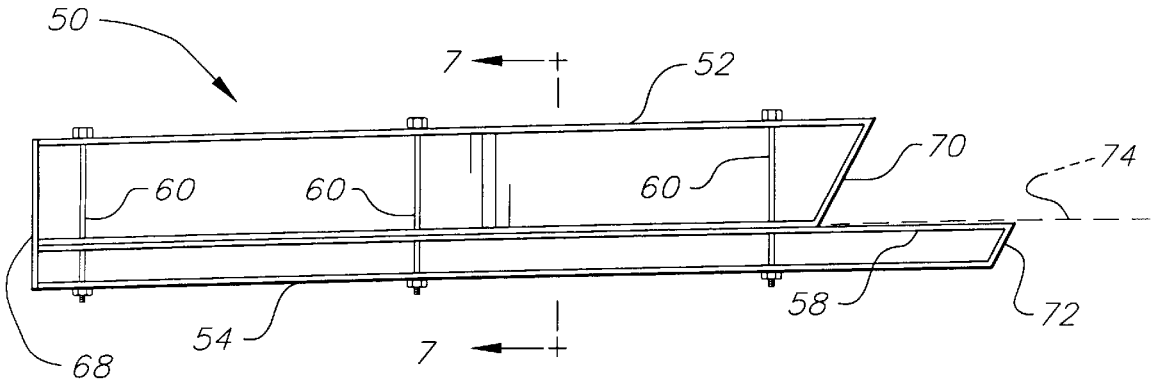
FIG. 5 is a lateral view of an end section of the roll beam girder system according to the present invention.

The end sections 50 are shown more particularly in FIG. 5. The end sections 50 are composed of a top section 52 and a bottom section 54. As shown most clearly in FIG. 7, the top section 52 and the bottom section 54 are two I-beams stacked vertically, disposed so that the bottom flange 56 of the top section rests on the top flange 58 of the bottom section 58. During assembly the top section 52 and the bottom section 54 are held in vertical alignment by tie rods 60 extending through the flanges of both beams on either side of the webs, and are joined by welding 62 the seams formed by the junction of the bottom flange 56 of the top section 52 and the top flange 58 of the bottom section 54.

The top section 52 of the end section 50 measures about two-thirds of the height of the end section 50 measured from the top flange 64 of the top section 52 to the bottom flange 66 of the bottom section. At one end the end section has a rectangular end plate 68, typically a ¾" plate, extending the height of the end section 50 and having a width equal to the length of the flanges 56, 58, 64, and 66 welded on to form an interface with the girder saddle 14 of the end support 12. At the other end of the end section 50 the top section 52 is cut transversely to its longitudinal axis and at an angle supplementary to the angle at the end of the top section 31 of the keystone section 30, and a ¾" end plate 70 is welded on. Preferably, the angle between the end plate 70 and the top flange 64 of the top section 52 is about 45°.

At this same end, the bottom section 54 of the end section 50 projects beyond the end plate 70 of the top section 52 so that the top flange 58 of the bottom section 54 extends beyond the junction of the end plate 70 for a distance substantially equal to the distance the bottom flange 34 of the keystone 30 projects beyond its junction with the end plate 44 of the key 40. At this end the bottom section is cut transversely to its longitudinal axis and at an angle supplementary to the angle formed by the junction of the key lock 40 with the top section 31 of the keystone section 30 and an end plate 72 is welded on. Preferably, the angle between the end plate 72 and the top flange 58 of the bottom section is substantially 45°.

The I-beam of the top section 52 of the end section has substantially the same dimensions in cross section as the dimensions of the I-beam of the keystone section in cross section. The triangular key locks 40 may be made from length of the same I-beam as the bottom section 54 of the end section 50. It will be seen from this construction the ends top section 31 of the keystone section 30 define a wedge shape adapted to interlock with notches defined by the ends of the top section 52 of the end sections 50, and the ends of the bottom sections 54 of the end sections 50 define a wedge shape which interlocks with notches defined by the key locks 40 of the keystone section 30, with a length of the top section 31 of the keystone 30 resting upon and compressing the bottom section 54 of the end sections 50 between the interlocking wedges.

The end sections 50 are so constructed that there is a slight degree of curvature or camber in the bottom section 54 such that there is a gap of between two and three inches between the end of the top flange 58 of the bottom section 54 and the plane 74 extending between the junction of the top section 52 and the bottom section 54 of the end section 50. Normally, when a load is placed in an I-beam, the top flange is in compression, the bottom in tension, and the web resists the shear stresses. The degree of curvature or camber is small enough that the bridge 10 is not classified as an arch bridge, but it is large enough the transfer the stresses from the load of the bridge 10 to the end supports 12. Hence the positive bending moment is balanced to some extent by the negative moment resulting from the horizontal thrust of the end supports 12.

Figure 6:
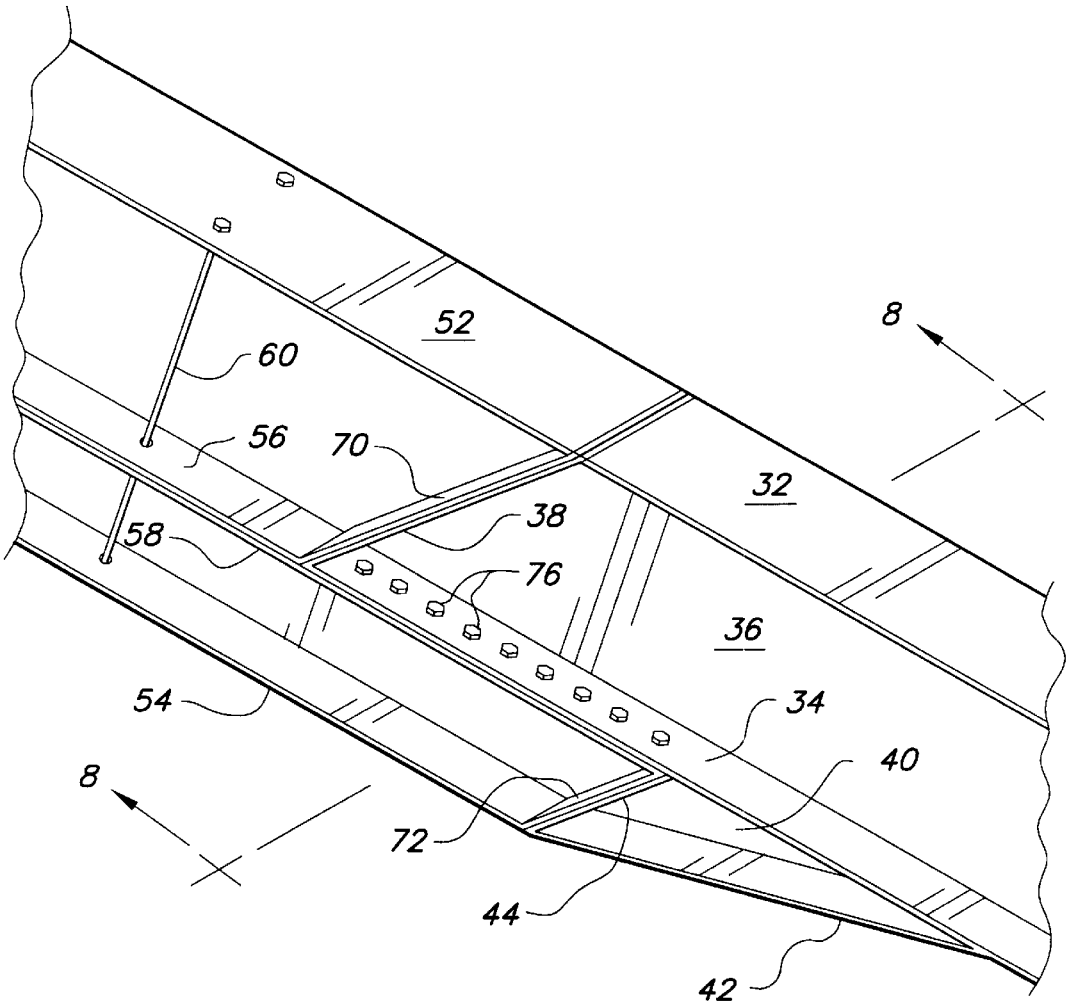
FIG. 6 is a perspective view of a compression splice of the roll beam girder system according to the present invention.
Figure 7:
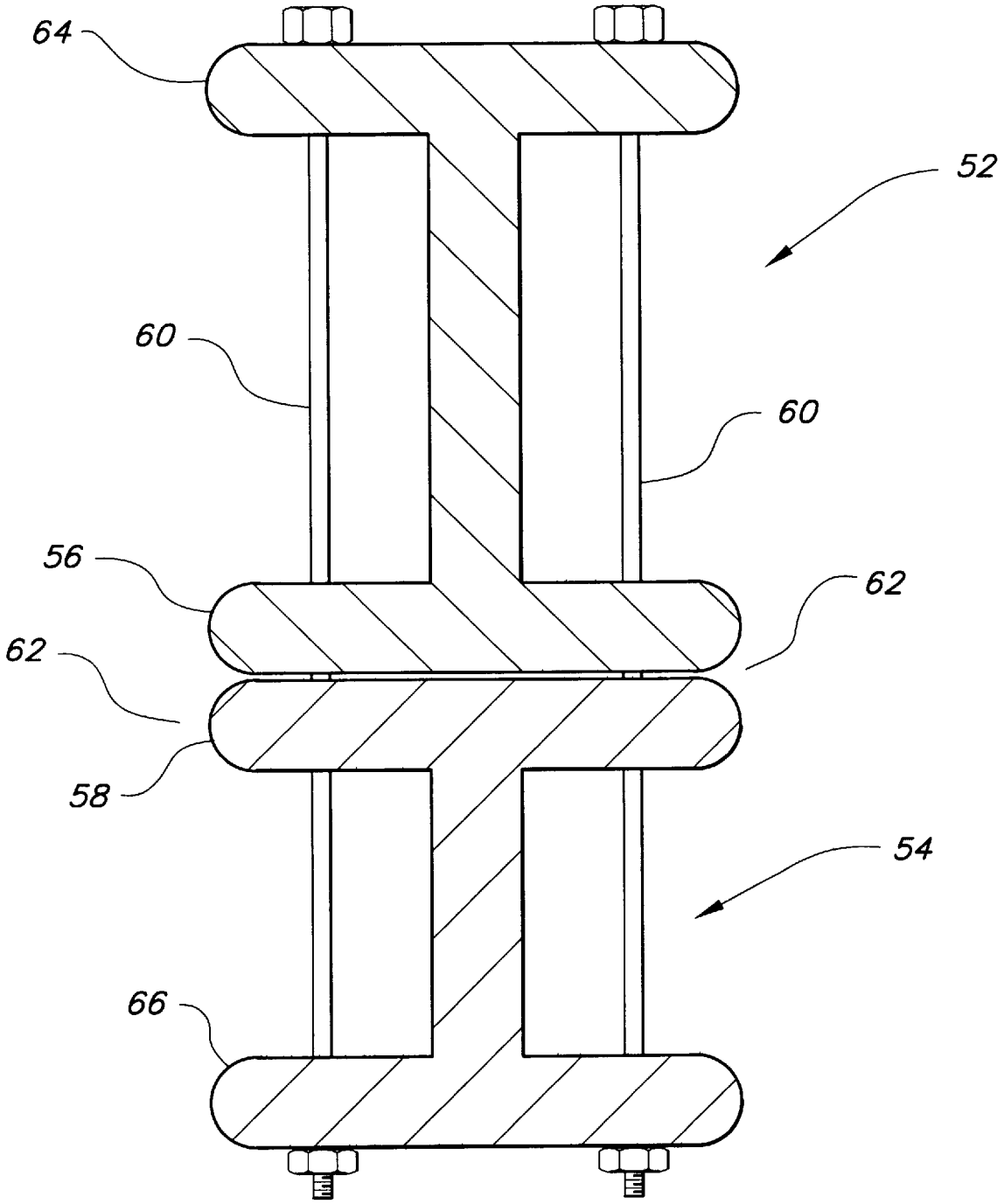
FIG. 7 is a cross section along the line 7—7 of FIG. 5.
Figure 8:
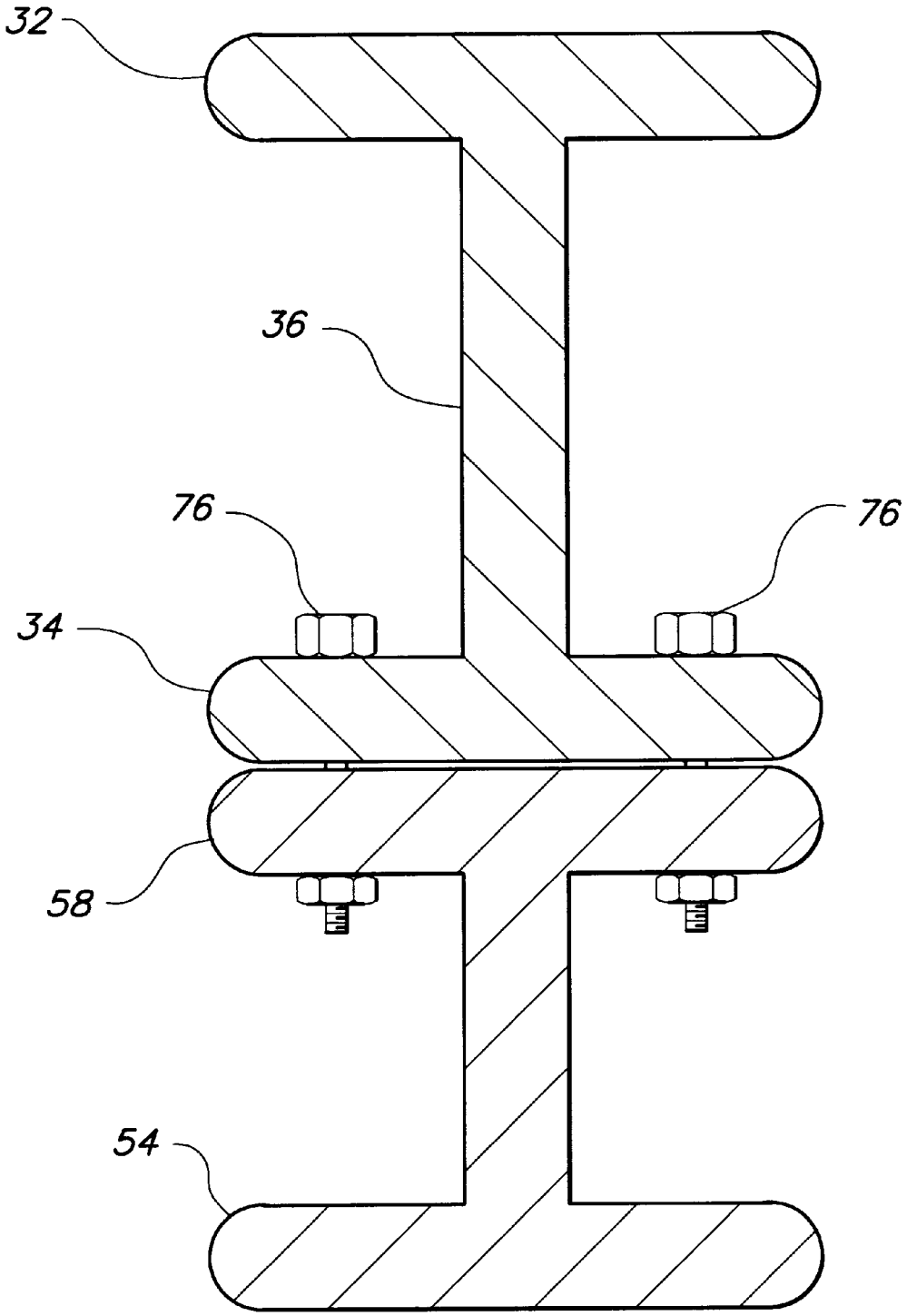
FIG. 8 is a cross section along the line 8—8 of FIG. 6.

The manner of splicing the keystone section 30 to the end sections 50 is a novel compression splice, shown more particularly in FIGS. 6 and 8. The bottom flange 34 of the keystone 30 rests on the top flange 58 of the bottom section 54 of the end section 50 with end plate 70 abutting end plate 38 and end plate 72 abutting end plate 44. The keystone 30 is fastened to the end section 50 by two rows of nine bolts 76 each, ¾" diameter high strength bolts placed about 12" center to center, one row on either side of web 36.

The end sections 50 are assembled as units in the shop, as is the keystone section 30. The maximum length of any one section is sixty feet. This method of construction permits the frame of the bridge 10 to be prefabricated and transported to the site of the bridge 10 without the necessity for obtaining special transportation permits for long loads required for integral beams. The keystone 30 is assembled to the end sections 50 at the bridge 10 site.

Once the roll beam girders 20 are in place, precast reinforced concrete planks 80 are welded to the top flanges 52 and 32 of the end sections 50 and the keystone section 30. The planks 80 may have angles 82 which are field welded to the reinforcing steel of the planks 80 and directly to the top flanges of the girder 20, or to shims 84 which are stitch welded to the top flanges of the girder 20, as shown in FIG. 2. The remainder of the space between the concrete planks 80 and the top of the girders 20 may be filled with an appropriate filler. The concrete planks 80 may serve as the roadway, or preferably as a flooring on which a two inch layer of concrete is poured to smooth the surface. The advantage of using precast reinforced concrete planks 80 is that the planks may be prefabricated in the shop, leaving only installation at the site, avoiding the safety hazards and additional time and expense associated with pouring concrete forms at the site of the bridge 10. Guard rails or side abutments (not shown) of conventional construction may be attached along the sides of the roadway.

Figure 9:
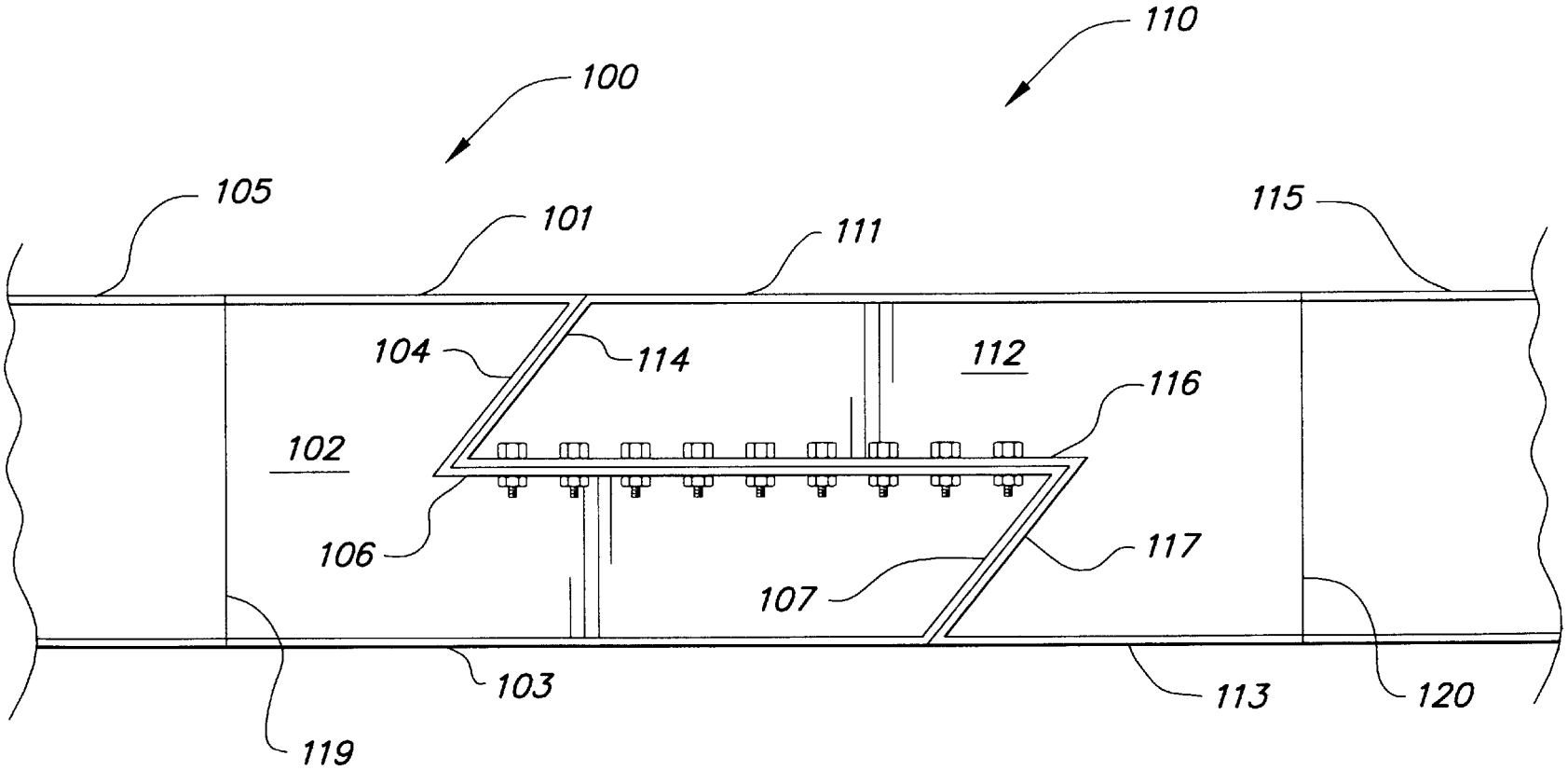
FIG. 9 is a lateral view showing the manner of making a compression splice for plate girders according to the present invention.

The method of making a compression splice in the roll beam girder system may be adapted for use with plate girders as shown in FIG. 9, as an alternative to the usual friction splice. A female extension 100 is joined at one end to a first plate girder 105 by a conventional web shop butt weld 119, and a male extension 110 is joined at one end to a second plate girder 115, also by a conventional web shop butt weld 120. The extensions 100 and 110 each have the same cross-sectional shape and dimensions as the first plate girder 105 and the second plate girder 115.

The other end of the female extension 100 is cut and has end plates 104, 106, and 107 joined to the cut edges perpendicularly its web 102 in such a manner that end plate 104 extends from the top flange 101 of the extension 100 to the midline of its web 102 and forms an angle of 45° relative to top flange 101, end plate 106 extends horizontally from end plate 104, projecting outward along the horizontal midline for a distance of approximately ten feet:, and end plate 107 extends from the end of end plate 106 to the bottom flange 103 of the extension, forming an angle of 135° relative to bottom flange 103.

The other end of the male extension 110 is cut and joined to end plates 114, 116, and 117 perpendicularly to its web 112 so that end plate 114 forms an angle of 135° relative to its top flange 111 and extends from the top flange 111 to the midline of the web 112, end plate 116 extends horizontally inward from the end of end plate 114 along the midline of the web 112, and end plate 117 extends from the end of end plate 116 to the bottom flange 113 of extension 110 and forms an angle of 45° relative to bottom flange 113.

It will be seen that this construction results in a structure in which the projecting end of male extension 110 rests on top of the projecting end of female extension 100, each of the projecting ends being one-half the height of each girder 105 and 115, the ends of the extensions 100 and 110 having wedge shaped mating 45° surfaces. The splice is secured by two rows of nine high strength bolts 125 each through the flanges 106 and 116 of the overlapping projecting ends. Thus, this compression splice presents an alternative method of joining plate girders.

It is to be understood that the present invention is not limited to the embodiments described above, but encompasses any and all embodiments within the scope of the following claims. It will be particularly understood that although FIG. 1 shows a single pair of roadway beams 20, the bridge 10 may comprise multiple parallel beams 20 to extend the width of the roadway. It will be further understood that the end supports 12 of the bridge 10 may have cross bracing between the foot of the pilings 16 and the adjacent end supports 12.

I claim:

1. A roll beam girder system for bridges comprising:

a) a keystone section, including:

i) a top section having a wedge shape defined at each end of the section;

ii) a bottom section including a pair of key locks attached to the top section, the key locks having a triangular shape and defining an angled notch at their junction with said top section; and wherein:

iii) the top section of said keystone section extends beyond said key locks, whereby said keystone section has a pair of projecting ends;

b) a pair of end sections, each end section having a top section and a bottom section, each end section having a first end and a second end, the first end of the end section being adapted for connection with an end support, the second end having an angled notch supplementary to the wedge shaped end of the top section of said keystone section and a wedge shaped end on the bottom section of the end section at an angle supplementary to the angled notch of said keystone section, the bottom sections of the second ends projecting beyond the end of the top sections of the second ends in order to support the ends of said keystone section and being slightly cambered in order to impart a slight degree of curvature to said roll beam girder; and c) wherein said keystone section is disposed between said pair of end sections, the projecting ends of the top section of said keystone section resting upon and being fastened to the projecting bottom sections of said end sections at each end of said keystone section.

2. The roll beam girder system for bridges according to claim 1, wherein:

a) the top section of said keystone section comprises a rolled steel beam having a top flange, a bottom flange, and a web integral with and disposed between the top flange and the bottom flange, being I-shaped in cross section, having its ends cut transversely to its longitudinal axis and at an angle, and having an end plate fixedly attached at each end, the end plate and the bottom flange defining a wedge shape;

b) the bottom section of said keystone section comprises said pair of key locks, each key lock being a triangular section cut from a rolled steel beam, having a bottom flange and having an end plate fixedly attached to the key lock, the end plate of said key lock being at an angle and defining a notch adapted to interlock with the wedge shaped end of the bottom section of said second end, the bottom flange of said key lock sloping from the end plate of the key lock to the bottom flange of said top section, terminating a distance from the midpoint of the longitudinal axis of said keystone section;

c) the top section and the bottom section of said end sections each comprise a rolled steel beam having a top flange, a bottom flange, and a web integral with a vertically disposed between the top flange and the bottom flange, said beams having an I-shaped cross section, the top section and the bottom sections of said end sections being stacked vertically and being retained in vertical alignment by a plurality of tie rods and fixedly connected by welding the bottom flange of the top section to the top flange of the bottom section;

d) the projecting ends of the top section of said keystone section are fastened to the projecting ends of the bottom section of said sections by a plurality of high strength bolts extending through the bottom flange of the top section of said keystone section and the top flange of the bottom section of said end sections; and e) the top sections of said end sections are about two-thirds of the height of said end sections, the height being measured from the top flange of the top section to the bottom flange of the bottom section of said end sections.

3. The roll beam girder system for bridges according to claim 2, wherein:

a) the end plate and the bottom flange of the top section of said keystone section define a 45° angle; and b) the wedge shaped end of the bottom section of the end sections define a 45° angle relative to the top flange of the bottom section of said end sections.

4. A single span roll beam bridge, comprising:

a) a plurality of end supports disposed at both ends of the span;

b) a plurality of roll beam girders according to claim 1, the girders being supported by said plurality of end supports;

c) a plurality of reinforced concrete planks extending transversely across said girders and being fixedly attached to the top of said girders; and wherein:

d) the bridge has a slight curvature at the center of its longitudinal axis, whereby the bending moments are fixed and the stresses are transferred to the end supports.

5. The single span roll beam bridge according to claim 4, further comprising a layer of concrete on top of said planks in order to form a smooth roadway surface on said bridge.

6. The single span roll beam bridge according to claim 4, wherein:

a) said roll beam girders are prefabricated in sections and transported to the bridge site; and b) said reinforced concrete planks are precast and transported to the bridge site.

7. A compression splice for joining two girders, comprising:

a) a first girder having a top section and a bottom section, wherein:

i) the top section has a wedge shaped end;

ii) the bottom section has a notch defined therein at the same end of the girder as the wedge shaped end of the top section;

iii) the top section extends beyond the bottom section, whereby said first girder has a projecting end;

b) a second girder having a top section and a bottom section, wherein:

i) the top section of said second girder has a notch defined at an end thereof adapted for interlocking with the wedge shaped end of the top section of said first girder;

ii) the bottom section of said second girder has a wedge shaped end at the same end of said second girder as the notch defined in the top section of said second girder, the wedge shaped end of the bottom section of said second girder being adapted for interlocking with the notch defined in the bottom section of said first girder;

iii) the bottom section of said second girder extends beyond the top section of said second girder, whereby said second girder has a projecting end; and wherein:

c) the projecting end of said first girder rests upon and is supported by the projecting end of said second girder, said projecting end of said first girder being fastened to the projecting end of said second girder.

8. The compression splice according to claim 7, wherein:

a) the top section of said first girder is a rolled steel beam having a top flange, a bottom flange, and an integral vertical web disposed between said top flange and said bottom flange, said beam having an I-shaped cross section;

b) the bottom section of said first girder is made from triangular key locks cut from a rolled steel beam;

c) the top section and the bottom section of said second girder each comprise a rolled steel beam having a top flange, a bottom flange, and a web integral with and vertically disposed between said top flange and said bottom flange, the top section and the bottom section of said second girder each having an I-shaped cross section, said top section and said bottom section being stacked vertically and vertically aligned, said top section and said bottom section being fastened together; and d) the projecting end of the top section of said first girder is fastened to the projecting end of said second girder by a plurality of high strength bolts extending through the bottom flange of the top section of said first girder and the top flange of the bottom section of said second girder.

9. The compression splice according to claim 7, wherein said first girder and said second girder are plate girders.

* * * * *